US006055890A

United States Patent [19]

Lim

[11] Patent Number: 6,055,890

[45] **Date of Patent: *May 2, 2000**

[54] SPANNER OR MONKEY SPANNER TO WHICH A FORCE TO ONLY ONE DIRECTION

[76] Inventor: Byeong-Hak Lim, 144-5, Moam-Dong, Gimcheon-Si, Gyeongsangbukdo, Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/811,725

[22] Filed: Mar. 6, 1997

[51] Int. Cl.[7] ..... B25B 13/02

[52] U.S. Cl. ..... 81/186; 81/119

[58] Field of Search ..... 81/119, 186

[56] References Cited

U.S. PATENT DOCUMENTS

| | | | |
|---|---|---|---|
| 3,757,614 | 9/1973 | Evans et al. | 81/119 |
| 3,762,244 | 10/1973 | Evans | 81/119 |
| 3,881,377 | 5/1975 | Evans et al. | 81/186 |
| 5,148,726 | 9/1992 | Huebschen et al. | 81/186 X |
| 5,181,439 | 1/1993 | Schwartz | 81/119 |
| 5,406,868 | 4/1995 | Foster | 81/186 X |

*Primary Examiner*—James G. Smith

*Attorney, Agent, or Firm*—Birch, Stewart, Kolasch & Birch, LLP

[57] ABSTRACT

A spanner adapted for operative engagement with a hexagonal element, comprising a handle, jaws disposed at one end of the handle, the jaws defining first and second clamping surfaces and a contacting surface, the first clamping surface being continuous on one side of the jaws, the second, opposing clamping surface being disposed on the other side of the jaws, the second clamping surface being interrupted by a recessed portion which separates the second clamping surface into long and short clamping surfaces with the recessed portion being disposed therebetween, the contacting surface connecting the first and second clamping surfaces, whereby when the spanner is rotated in the clockwise direction the jaws engage the hexagonal element and when the spanner is rotated in the opposite direction, a protruding portion of the hexagonal element falls into the recessed portion, permitting the spanner to be repositioned for clockwise rotation.

12 Claims, 4 Drawing Sheets

SPANNER OR MONKEY SPANNER TO WHICH A FORCE TO ONLY ONE DIRECTION

BACKGROUND OF THE INVENTION

The present invention relates to a spanner or monkey spanner to which a force can be applied in only one direction, wherein the jaws are constructed so that a force can be applied in only one direction for rotating the spanner for tightening or releasing an element such as a hexagonal head bolt or a hexagonal nut.

In general, a spanner or a monkey spanner is used when tightening or releasing a tightening element such as a hexagonal head bolt or a hexagonal nut. However since the clamping jaws of the spanner are constant in dimension, when the element to be tightened is inserted into the clamping jaws, they first should be turned a predetermined rotating angle and thereafter removed and returned to their original position and then again inserted around the bolt or nut to repeat the procedure. This creates the disadvantage whereby the working procedure becomes inconvenient and slow.

SUMMARY OF THE INVENTION

The present invention inconvenience, and it is an object of the present provides a spanner or monkey spanner in which the jaws are specially made whereby the element to be tightened is inserted within the jaws and rotated in only one direction.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Hereinafter, the present invention will be described in more in detail with reference to the accompanying drawings.

FIG. 1 to FIG. 4, show the structures of the spanner and monkey spanner of the present invention.

Figure 3:
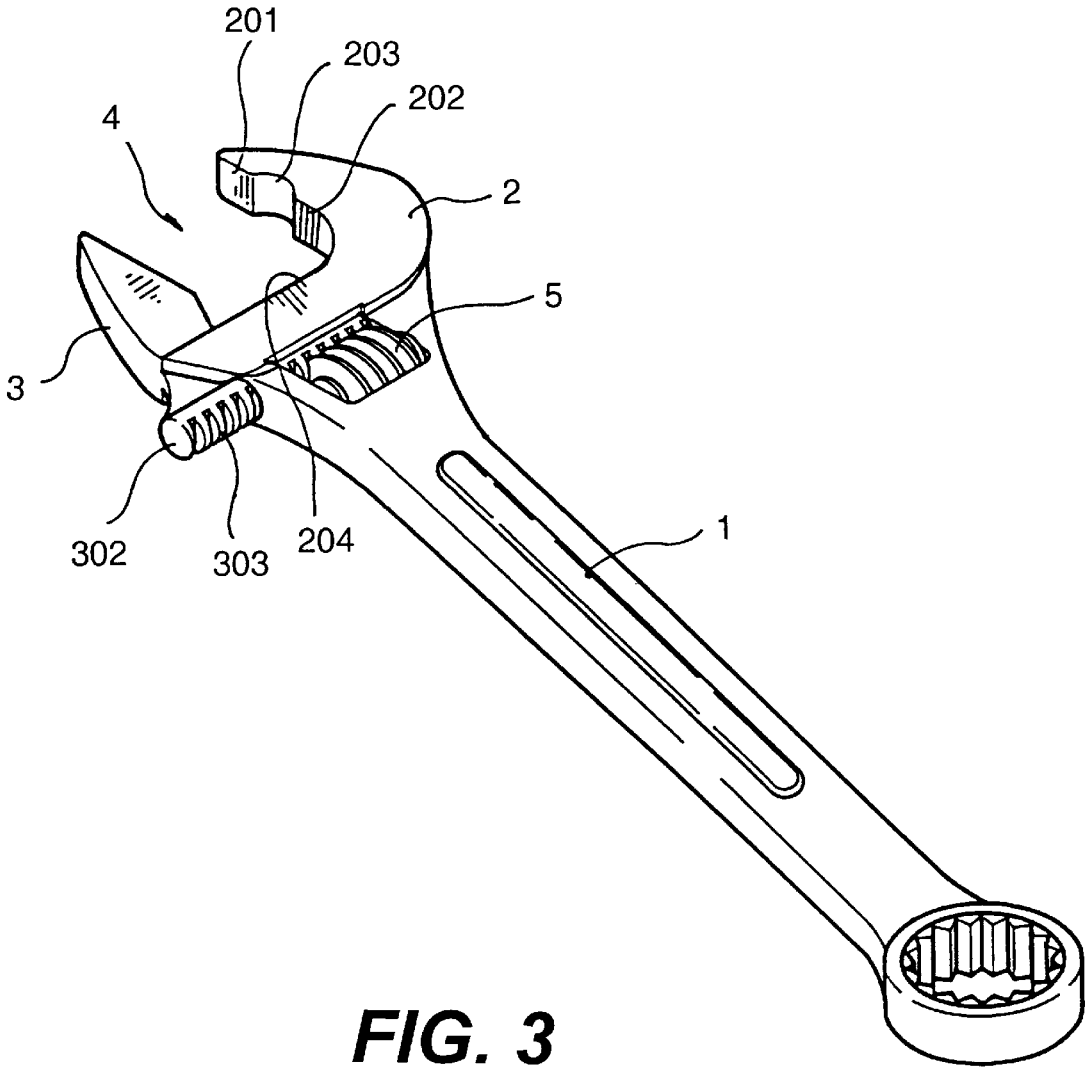
FIG. 3 is an exemplary view showing an embodiment of a monkey spanner in accordance with the present invention.
Figure 4:
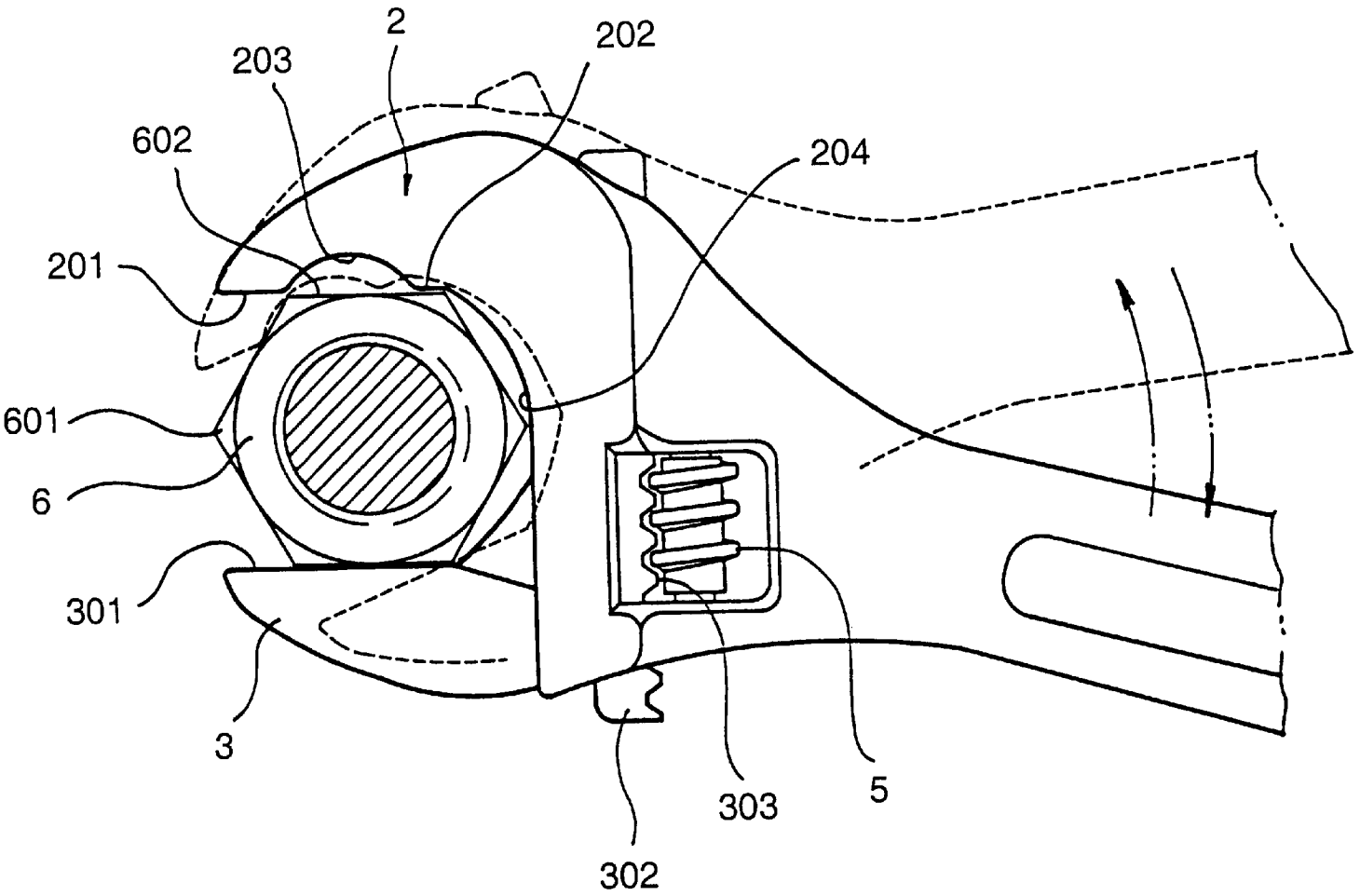
FIG. 4 is a magnified view of the jaws of FIG. 3.

The spanner of the present invention has jaws 4 formed by a clamping portion 2 formed at an end of the handle 1, clamping surfaces 201 and 205 are formed on both sides of the jaw and a cut-out recess 203 is formed within the clamping surface 201 and 202 at one portion of the jaw. A hexagonal nut 6 or a hexagonal head bolt is clamped by the short clamping surface 202 and the opposite side clamping surface 205 so that the spanner can be rotated in a direction having no cut out recess 203. The monkey spanner of the present invention can also have a structure as shown in FIG. 3 and FIG. 4 wherein a movable jaw 3 is provided at one side of the clamping portion 2 formed at an end of the handle 1 forming movable type jaws 4. The cut out recess 203 is formed with the remaining a clamping surface 202 at a portion of the fixed clamping wall 201 of the clamping portion 2. A hexagonal nut or a hexagonal head bolt is clamped within the jaws 4 by the short clamping surface 202, the contacting surface 204 and the clamping surface 301 of the movable jaw 3. When the monkey spanner is rotated in opposite direction formed with the cut out recess 203, the tightening part clamped by the jaws can be rotated.

Figure 1:
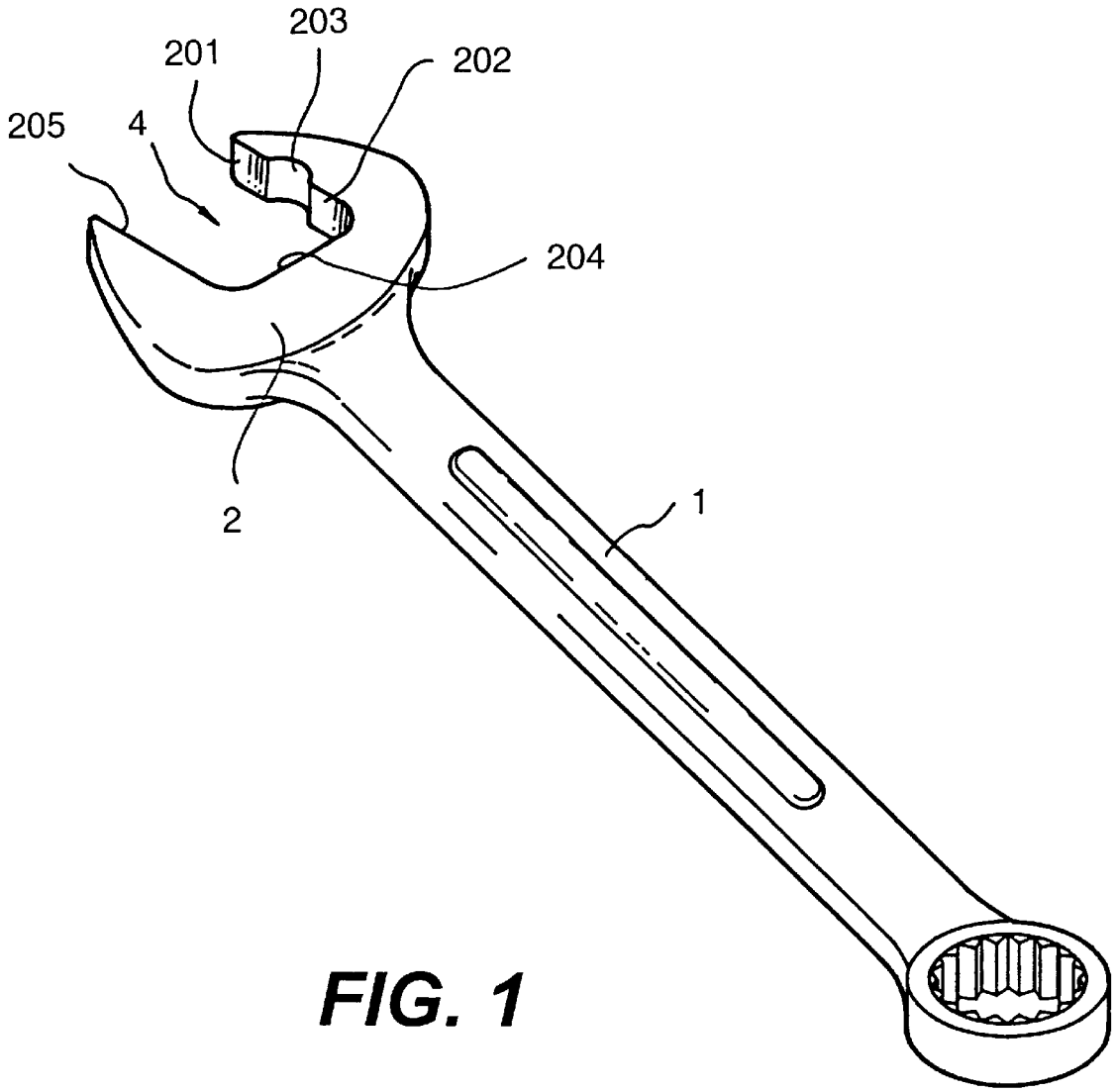
FIG. 1 is a perspective view showing an embodiment of a spanner in accordance with the present invention.
Figure 2:
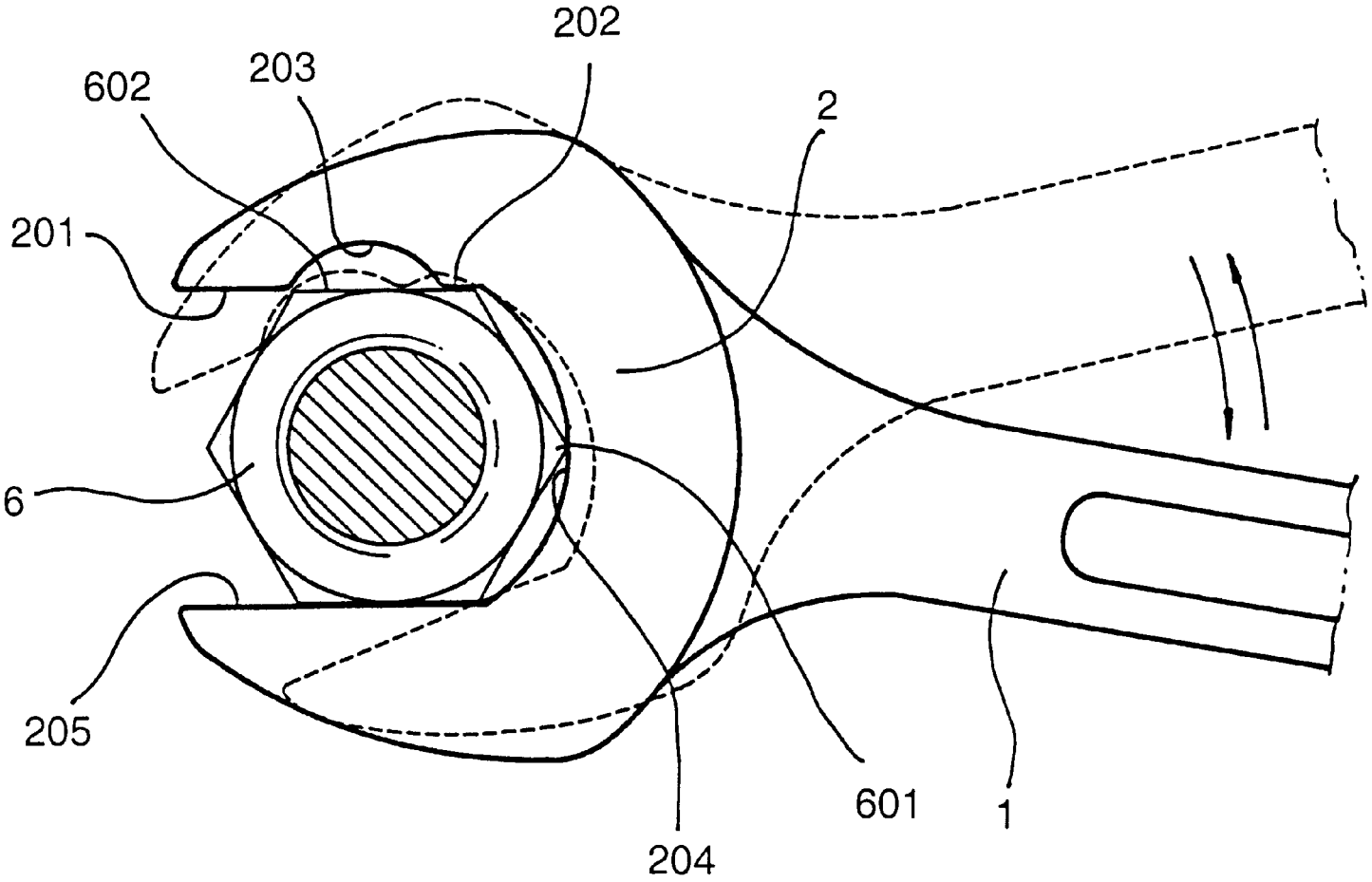
FIG. 2 is a magnified view of the jaws of FIG. 1.

In accordance with the present invention, when the hexagonal nut 6 is inserted into the jaws 4 of the spanner so that the protruding angle 601 is maintained at a center of the contacting surface 204, since the clamping surface 602 of the hexagonal nut 6 is clamped by the clamping surface 205 and the clamping surface 202, as shown in FIG. 2, a force is applied when the spanner is rotated clockwise. On the other hand, the protruded angle 601 of the hexagonal nut 6 is positioned into the cut out recess 203 whereby the spanner is rotated in idle when the spanner is rotated counter clockwise. Thus the short clamping surface 202 makes contact with the next clamping surface 602. Accordingly, when the spanner is rotated in the clockwise direction the nut can be continuously rotated, and as in the case of the monkey spanner, when the hexagonal nut 6 is inserted into the movable jaws 4 and the clamping distance is adjusted whereby the protruded angle 601 of the nut 6 is maintained in the center of the contacting surface 204, the clamping surface 602 of the hexagonal nut 6 is clamped between the clamping surface 301 of the movable jaw 3 and the clamping surface 202 of the clamping portion 2 as shown in FIG. 4. Thus, the spanner can continuously rotate the nut 6 in the clockwise direction, and when the spanner is rotated to its opposite direction, the protruding angle 601 of the hexagonal nut 6 falls into the cut out recess 203 whereby the spanner rotates in idle.

Accordingly, in the state where the hexagonal nut 6 is inserted into the jaws 4, a force is applied only when the monkey spanner is rotated in a direction opposite from the clamping portion containing the cut out recess 203 whereby the hexagonal nut can be tightened. When it is desired release the nut, the hexagonal nut can be released by rotating the monkey spanner by clamping after turning over the clamping portion of the monkey spanner.

Therefore, in the monkey spanner of the present invention, since the nut is clamped within the jaws of the monkey spanner and can be tightened or released by rotating the monkey spanner in only one direction, opperative process becomes speedy convenient, and particularly because a cut out recess is provided in the fixed clamping wall.

What is claimed is:

1. A spanner adapted for operative engagement with a hexagonal element, which comprises:

a handle, jaws disposed at one end of the handle, said jaws defining first and second clamping surfaces and a single continuous contacting surface, the first clamping surface being a single continuous surface on one side of the jaws, the second, opposing clamping surface being disposed on the other side of the jaws, said second clamping surface being interrupted by a recessed portion which separates the second clamping surface into long and short planar clamping surfaces with the recessed portion being disposed therebetween, said single continuous contacting surface connecting the first and second clamping surfaces, whereby when the spanner is rotated in the clockwise direction the jaws engage the hexagonal element and when the spanner is rotated in the opposite direction, a protruding portion of the hexagonal element falls into the recessed portion, permitting the spanner to be repositioned for clockwise rotation.

2. The spanner of claim 1, wherein at least one of the clamping surfaces is movable relative to the other clamping surface.

3. The spanner of claim 1, wherein the first clamping surface is movable relative to the second clamping surface.

4. The spanner of claim 1, wherein said single continuous contacting surface extends from an end of said short planar clamping surface to an end of said first clamping surface.

5. The spanner of claim 1, wherein said first surface is capable of contacting an entire side of the hexagonal element during operation of said spanner.

6. The spanner of claim 5, wherein said contacting surface is capable of contacting only a protruding portion of the hexagonal element during operation of said spanner.

7. The spanner of claim 1, wherein said first and second clamping surfaces are generally parallel to each other.

8. The spanner of claim 1, wherein said first clamping surface, said long planar clamping surface, and said short planar clamping surface are generally parallel surfaces, said short planar surface extending in a lengthwise direction the same as the lengthwise direction of said long planar surface.

9. The spanner of claim 1, wherein said short planar clamping surface is capable of contacting a portion of a side of the hexagonal element directly adjacent to a protruding portion during operation of said spanner.

10. The spanner of claim 1, wherein said short surface is engageable with a portion of a side of the hexagonal element extending from a protruding portion of the hexagonal element a predetermined distance along the side of the hexagonal element.

11. The spanner of claim 6, wherein said single continuous contacting surface slidably engages the protruding portion of the hexagonal element during rotation of said spanner in the opposite direction to the clockwise direction.

12. A spanner adapted for operative engagement with a hexagonal element, comprising:

a handle;

jaws disposed at one end of said handle, said jaws including:

a first, single, continuous clamping surface engageable with an entire side of the hexagonal element;

a second clamping surface including a long surface and a short surface interrupted by a recessed portion; and a single, continuous contacting surface directly connecting an end of said short surface to an end of said first, single, continuous clamping surface; and said short surface is engageable with a portion of a side of the hexagonal element extending from a protruding portion of the hexagonal element a predetermined distance along the side of the hexagonal element.

* * * * *

UNITED STATES PATENT AND TRADEMARK OFFICE

CERTIFICATE OF CORRECTION

PATENT NO. 6,055,890

DATED May 2, 2000

INVENTOR(S) : Byeong-Hak LIM

It is certified that error appears in the above-identified patent and that said Letters Patent is hereby corrected as shown below:

Change the title of the patent from "SPANNER OR MONKEY SPANNER TO WHICH A FORCE TO ONLY ONE DIRECTION" to --SPANNER OR MONKEY SPANNER TO WHICH A FORCE IS APPLIED IN ONLY ONE DIRECTION--.

Signed and Sealed this

Tenth Day of April, 2001

*Attest:*

Nicholas P. Godici

NICHOLAS P. GODICI

*Attesting Officer*

*Acting Director of the United States Patent and Trademark Office*